US009816713B2

(12) United States Patent
Bauer

(10) Patent No.: US 9,816,713 B2
(45) Date of Patent: Nov. 14, 2017

(54) TWO-CHANNEL AIR CONDITIONER FOR THE FLEXIBLE CLIMATE CONTROL OF A NUMBER OF ROOMS

(75) Inventor: Albert Bauer, München (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1074 days.

(21) Appl. No.: 12/867,923

(22) PCT Filed: Feb. 23, 2009

(86) PCT No.: PCT/EP2009/001273

§ 371 (c)(1),
(2), (4) Date: Oct. 22, 2010

(87) PCT Pub. No.: WO2009/103563

PCT Pub. Date: Aug. 27, 2009

(65) Prior Publication Data

US 2011/0042055 A1 Feb. 24, 2011

(30) Foreign Application Priority Data

Feb. 22, 2008 (DE) ..... 10 2008 010 656

(51) Int. Cl.
*F24F 3/00* (2006.01)
*F24F 3/052* (2006.01)
*F24F 11/00* (2006.01)

(52) U.S. Cl.
CPC ..... *F24F 3/0522* (2013.01); *F24F 2011/0042* (2013.01)

(58) Field of Classification Search
CPC .. F24F 11/0009; F24F 11/001; F24F 11/0012; F24F 11/0015; F24F 11/0017
(Continued)

(56) References Cited

U.S. PATENT DOCUMENTS 2,038,579 A * 4/1936 Lamb ..... 165/209
2,613,919 A * 10/1952 Russell et al. ..... 165/203
(Continued)

FOREIGN PATENT DOCUMENTS

CH 576 609 A 7/1975
DE 1 454 615 A 2/1969
(Continued)

OTHER PUBLICATIONS

European Examination Report, European Patent Office, dated Jul. 16, 2012, European Application No. 09712480.4-2301, Applicant: Bauer, Albert, Munich, Germany, pp. 1-5.
(Continued)

*Primary Examiner* — Claire Rojohn, III
(74) *Attorney, Agent, or Firm* — Woodling, Krost and Rust

(57) ABSTRACT

The invention relates to a two-channel air-conditioner (10) for the climate control of a number of rooms (44, 46, 48) and/or room zones, having an air inlet device (52) in every room (44, 46, 48) to be climate controlled, having at least one pair of supply air channels (20, 22) wherein at least one supply channel (20, 22) comprises a cooling and/or heating register (32, 34; 58, 60) having at least one temperature regulator for each room (44, 46, 48) to be climate controlled, which keeps the room (44, 46, 48) to be climate controlled at a room temperature ($T_{room\ target}$) which can be set, having valve units (54, 72), which connect the supply air channels (20, 22) to the air inlet device (52). The invention is characterized in that it allows switching, the cooling or heating register (32, 34; 58, 60) is only opened as needed if the temperature in at least on of the supply air channels (20,22) is insufficient for cooling or heating the room (44, 46, 48) to be climate controlled.

17 Claims, 1 Drawing Sheet

(58) Field of Classification Search
USPC ..... 165/212
See application file for complete search history.

(56) References Cited

U.S. PATENT DOCUMENTS

| | | | | |
|---|---|---|---|---|
| 2,729,429 | A | 1/1956 | Goemann | |
| 2,753,157 | A * | 7/1956 | Hoyer | 165/212 |
| 3,901,310 | A | 8/1975 | Strawn | |
| 3,934,795 | A * | 1/1976 | Ginn | F24F 3/0522 165/256 |
| 4,039,124 | A | 8/1977 | Ginn et al. | |
| 4,948,040 | A * | 8/1990 | Kobayashi | F24F 11/0009 165/217 |
| 5,407,002 | A * | 4/1995 | Voll | 165/11.1 |
| 6,688,384 | B2 * | 2/2004 | Eoga | 165/212 |
| 2003/0146289 | A1 * | 8/2003 | Sekhar | F24F 3/0442 236/49.3 |
| 2008/0135635 | A1 * | 6/2008 | Deng | F24F 3/1405 236/44 C |
| 2009/0030555 | A1 * | 1/2009 | Gray | 700/277 |
| 2010/0320277 | A1 * | 12/2010 | Stark | 236/1 B |

FOREIGN PATENT DOCUMENTS

| | | | |
|---|---|---|---|
| DE | 1 454 635 | A | 3/1969 |
| DE | 21 35 934 | A | 1/1973 |
| DE | 25 53 380 | A1 | 8/1976 |
| DE | 33 07 116 | A1 | 9/1984 |
| DE | 35 09 621 | C2 | 9/1986 |
| DE | 198 47 504 | C1 | 11/2000 |
| DE | 1 580 983 | A | 12/2010 |
| GB | 22 35 551 | A | 3/1991 |
| JP | 62202955 | A | 9/1987 |
| JP | S62202955 | | 9/1987 |
| JP | 02115648 | A | 4/1990 |
| JP | H06272933 | | 9/1994 |
| JP | H06100361 | | 12/1994 |

OTHER PUBLICATIONS

Office Action, Japanese Patent Office, Japanese Patent Application No. 2010-547120, English Translation of Notification of Reasons for Refusal, Drafting Date: Jun. 25, 2012, dated Jun. 27, 2012, pp. 1-2.

Examination Report, New Zealand Intellectual Property Office, New Zealand Patent Application No. 588114, Applicant: Bauer, Albert, dated Mar. 6, 2012, Wellington, New Zealand, pp. 1-2.

Office Action, Indonesian Patent Office, Indonesian Patent Application No. W-00201003214, Applicant: Bauer, Albert, dated Oct. 17, 2012, pp. 1-2.

Office Action, Chilean Patent Office, Chilean Application No. 0908-10, Applicant: Bauer, Albert, dated Apr. 16, 2012, pp. 1-8.

Office Action, Belarus Patent Office, Belarusian Application No. a 20101356, dated Nov. 5, 2012, pp. 1-6.

Office Action, Chilean Patent Office, Chilean Application No. 2010-000908, Filing Date August 25, 2010, Applicant: Bauer, Albert, Santiago, Chile dated Nov. 28, 2012, pp. 1-4.

International Search Report, dated May 29, 2009, PCT/EP2009/001273, WO2009/103563A1.

Mexican Institute of Industrial Property, Mexican Patent Office, Office Action, PCT MX/a/2010/008810, pp. 1-3, dated May 8, 2013, Mexico.

* cited by examiner

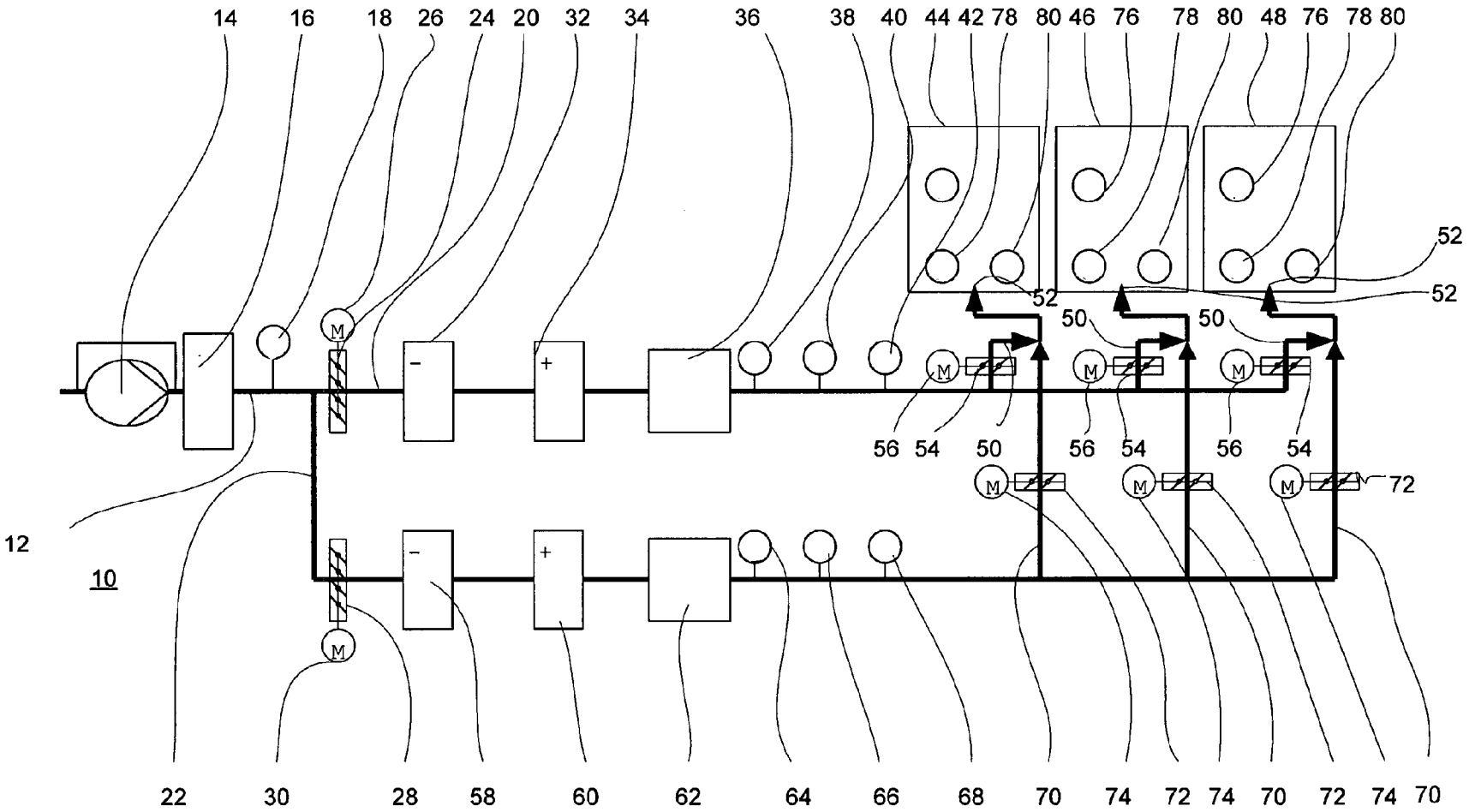
14
16
18
26
24
20
32
34
36
38
40
44
42
78
80
46
76
78
80
48
76
78
80
52
52
50
50
50
54
54
54
56
56
56
72
70
74
72
70
74
72
74
70
68
66
64
62
60
58
28
30
22
10
12

TWO-CHANNEL AIR CONDITIONER FOR THE FLEXIBLE CLIMATE CONTROL OF A NUMBER OF ROOMS

This is the national entry of PCT/EP2009/001273, international application filing date Feb. 23, 2009. Applicant claims priority to German Patent Application No. DE 10 2008 010 656.9 filed on Feb. 22, 2008 which is hereby incorporated by reference.

The invention relates to a two-channel air-conditioner for the climate control of a number of rooms.

Rooms, in particular of buildings, can, for example, be subjected to differing heat and cooling loads because of their orientation to the north or to the south, their orientation with respect to dominant wind directions or because of the devices which are in such rooms. Therefore, one-channel air-conditioners and zones air-conditioners are not always adapted for the climate control of buildings having a number of rooms since the air to be climate controlled has to be supplied, in such cases, at differing conditions into the rooms to be climate controlled.

For this purpose, two-channel air-conditioners have been built in many times in the past. Therein, outside air is sucked in from the outside and is conveyed by an outside air blower after some basic treatment. In the one outside air channel, the outside air is heated by means of an air heater—heating register. Thereby, this channel forms the hot air channel. In the other outside air channel, the outside air is cooled by a surface cooler—cooling register. Thereby, this channel forms the cold air channel. Each individual air outlet in the room to be climate controlled comprises a connection to the hot air channel and the cold air channel through a mixing box. Therefore, the mixing boxes are provided in order to connect the air outlet with the connections at the hot air channel and the cold air channel. The hot air from the hot air channel and the cold air from the cold air channel are mixed with each other in the mixing boxes. For this purpose, a mixing device is inserted into the mixing boxes which device comprises a pneumatic positioning motor, a cold air valve cooperating with the cold air channel and a hot air valve cooperating with the hot air channel. By means of a pneumatic positioning motor, the valve positions are coupled to each other. In case the valve to the hot air channel is opened to 30%, the valve to the cold air channel is, at the same time, opened to 70%. Thereby, always an opening amount of 100% is obtained whereby the quantity of air which is conveyed through the mixing box remains always the same.

By actuating the valves through the positioning motor, the mixing of the hot air and the cold air is controlled while maintaining the amount of air. For example, rooms having a maximum of cooling load receive only cold air—valve to the cold air channel is open to 100%; and, at the same time, the valve to the hot air channel is open to 0%—and rooms having a maximum of heat load receive only hot air—the valve to the hot channel is open to 100% and, at the same time, the valve to the cold air channel is open 0%—and rooms having a partial load receive a mixture of cold air and hot air with corresponding opening positions of the valves.

Such an air conditioning system is, for example, known from the book "Recknagel, Sprenger, Schramek; Taschenbuch für Heizung und Klimatechnik (pocketbock for heating and climate technology), München a. o., Oldenburg Industrieverlag, 2003, pages 1093 to 1096.

Also the DE 35 09 621 C2, the DE 33 07 116 A1, the DE 1 454 635 A, the DE 1 454 615 A, the DE 21 35 934 A and the CH 576 609 A each relate to a two-channel air-conditioner as mentioned above. Systems of ventilation technology are apparent from DE 1 580 983 A as well as DE 198 47 504 C1.

It is a deficiency of the two-channel systems mentioned above, that hot air and cold air have to be permanently made available in summer time as well as in winter time in the hot air channel as well as in the cold air channel. Therefore, a register in one channel is activated at all times. Furthermore, a nearly constant amount of air is permanently fed into both channels in known systems at all times. An individual increasing of the amount of air in order to provide faster cooling or heating is not possible. Therefore, the known two-channel air-conditioners have very high energy consumption and are very inflexible. A reduction of the energy consumption is not possible with such systems up to now.

The invention is based on the object to further develop such a two-channel air-conditioner such that the flexibility is increased. Furthermore, the preconditions should be provided in order to substantially reduce the energy consumption, and, in particular, to enable adaption of existing two-channel air-conditioners to the invention.

Further advantages and features of the invention are subject to the sub-claims.

The invention is based on the finding that the coupling of the valve devices fails to meet the individual air-conditioning requirements in the rooms to be climate controlled, and that, thereby, waste of energy is encountered. By decoupling the valve units, this problem can be solved in a simple way. It is now possible to introduce the maximum amount of input air from one input air channel as well as the maximum amount of input air from the other input air channel into a room to be climate controlled on demand. A fast adaption to the required conditions and a high flexibility is achieved thereby.

Therefore, according to the invention, the valve units are formed independent from each other such that the amounts of air from the respective supply air channels to the individual rooms to be climate controlled are adjusted independently from each other.

According to an embodiment of the invention, the valve unit is each formed and controlled such that also only one of the supply air channels is connected to the air inlet device of a room to be climate controlled.

Preferably, one of the factors pressure, temperature, moisture, density in the supply air channel may be used as a control parameter for the control/regulation independent from the respective factor in the other supply air channel. Thereby, the flexibility and the possibility to optimize the system are further improved.

According to a further aspect of the invention, it is based on the finding that the cooling register or the heating register in the respective channel has to be activated only on demand whereby it is possible to considerably reduce the energy consumption. Thereby, further multiple possibilities for optimizing the saving of energy are obtained.

Preferably, the two-channel air-conditioner comprises a circuit cooperating with the temperature regulators of the room to be climate controlled which circuit is connected to the temperature sensors in the supply air channels, the temperature sensors in the rooms to be climate controlled and the cooling register or heating register arranged at least in one supply air channel, whereby the circuit outputs a positioning signal opening the cooling register or the heating register only in case the temperature in at least one supply air channel is not sufficient for cooling or heating the rooms to be climate controlled in considering the conveyed amount of air. Thereby, substantial energy costs can be saved in a simple way since the cooling register and/or the heating register are now not permanently activated anymore.

Therein, preferably, the pressure in the supply air channel is controlled depending on the required air quantities through the flaps forming the valve unit and/or a supply air motor.

In particular each supply air channel may comprise a heating register and/or a cooling register or, as an alternative thereto, one supply air channel may comprise a heating register and the second supply air channel may comprise a cooling register.

According to a further embodiment of the invention, the cooling and heating register of the supply air channel are adjustable independently from each other in a predefined temperature range.

Because of the changed valve control for both supply air channels, the former designation to a hot air and a cold air channel as well as the previously required mixing box can be completely dispensed with. Furthermore, further possibilities of the control of the air quantity also with respect to the heating- or cooling demand are obtained thereby.

Further energy costs can also be saved in that the minimum temperature of the supply air in the supply air channels corresponds essentially to the minimum temperature of the system at which it does not become damaged, for example 12° C.

Preferably, also the amount of air supplied to the individual supply air channels, is varying independently form each other. Therein, the amount of supply air for the individual rooms to be climate controlled or room zones may vary depending on the difference between the temperature in the room to be climate controlled ($T_{room\ actual}$) or the room zone to be climate controlled or the predetermined temperature target value ($T_{room\ target}$) as well as depending on the supply air temperature. Therein, the amount of air is increased as needed such that a fast heating or cooling is ensured with an optimum of comfort.

Preferably, moistening and/or de-moistening devices are provided for the supply air at least in one supply air channel which may be activated on demand.

Furthermore, also additional cooling and/or heating units for the supply air may be provided in at least one supply air channel which units are adapted to be switched-in on demand.

A further possibility for the control is provided by means of the values of the density in the room and the supply air channel.

Basically, a device for pre-treating the air may be provided in front of each supply air channel in which device the air is heated, cooled, moisturized or de-moisturized on demand.

According to an embodiment of the invention, the supply air channels are designed for differing supply air quantities. The cooling and/or heating registers and/or the moistening and de-moistening devices may be designed according to the maximum possible air supply quantities in the respective air supply channels as well.

Further advantages, features and possibilities of usage of the present invention can be taken from the following description in connection with the embodiment shown in the drawing.

The invention is described in more detail in the following with reference to the embodiment shown in the drawing. In the specification, the claims, the abstract and the drawing the terms used in the below list of reference signs and the related reference signs are used. In the drawings:

FIG. 1 is a block circuit diagram of a two-channel air-conditioner according to the invention.

In FIG. 1, a block circuit diagram of a two-channel air-conditioner 10 according to the invention is shown. The two-channel air-conditioner 10 comprises a central supply air channel 12. In this central supply air channel 12 a supply air motor 14 as well as a heating register 16 is inserted which is located downstream of the supply air motor 14. A temperature sensor 18 is arranged downstream of the heating register 16.

The central supply air channel 12 is branching off into a first supply air channel 20 and a second supply air channel 22. In the first supply air channel 20, a flap 24 is inserted which is driven by a motor 26. In the same way, a flap 28 is inserted into the second supply air channel 22 which flap is driven by a motor 30. The variable amount of air for the first and the second supply air channel 20 and 22 is adjusted by the flaps 24, 26 and by the supply air motor 14.

Downstream of the flap 24 in the first supply air channel, firstly, a cooling register 32, thereafter, a heating register 34 and, finally, a moistening device 36 are arranged. Finally, a temperature sensor 38, a moisture sensor 40 as well as a pressure sensor 42 are inserted into the first supply air channel 22 downstream of the moistening device 36. The first supply air channel is adapted to be connected to the rooms 44, 46 and 48 each.

For this purpose, a branch channel 50 is provided each which is connected to a air inlet 52 in the middle of the respective room 44, 46, 48. The branch channel 50 is a part of the first supply air channel 20. In this branch channel 50, a flap 54 is provided which is adapted to be actuated by a motor 56.

In the same way as in the first supply air channel 20, also the second supply air channel 22 is arranged. Downstream of the flap, a cooling register 58, a heating register 60 as well as a moistening device 62 are arranged. The moistening device 62 is followed by a temperature sensor 64, a moisture sensor 66 as well as a pressure sensor 68.

From the second supply air channel 22, a second branch channel 70 each is branching of which is connected to the air inlet 52 of the respective rooms 44, 46, 48. In the second branch channel 70, a flap 72 is arranged which is actuated by a motor 74.

A temperature sensor 76, a moisture sensor 78 as well as air quality sensor 80 are each provided in the rooms 44, 46, 48. The temperature in the room 44, 46, 48 is controlled by means of the individual sensors. In the control circuit, a respective target value is pre-defined for the respective room. Therein, the cooling register 32, 58, the heating register 34, 60 and the moisture device 36, 62 are activated in the respective supply air channel 20, 22 only in case the temperature for cooling or heating the room to be climate controlled or the degree of moistening is not achieved at least in one of the supply air channels 20, 22. As a rule, the air inlet 52 in the room 44, 46, 48 to be climate controlled, is only connected to one supply air channel 20 or 22. Therefore, the air is not mixed anymore contrary to the previously known state of the art, but is taken either from the first supply air channel 20 or the second supply air channel 22.

The amount of air is respectively adjusted by the flaps 54 and 72. The quantity of supply air for the respective rooms 44, 46, 48 to be climate controlled varies depending on the difference between the temperature in the room to be climate controlled and the pre-defined temperature as well as depending on the supply air temperature. For this purpose, the respective temperature sensors 18, 38 and 76 are provided.

The pressure in the supply air channels 20, 22 is controlled depending on the required amount of air in the rooms 44, 46, 48 to be climate controlled, by means of the flaps 24, 28, 54, 72 as well as the supply air motor 14.

The cooling registers 32, 58, the heating registers 34, 60 as well as the moistening devices 36, 62 are only activated when the temperature in the respective supply air channels 20, 22 and/or the values of the density and/or the values of the moisture are not in conformity with the targets.

The cooling registers 32, 58 as well as the heating registers 16, 34 and 60 are adapted to be adjusted in a pre-determined temperature range.

The flaps 54 and 72 form a kind of valve installation. It is formed such that, according to the demand, also only one of the supply air channels 20, 22 is connected to the air inlet 52 in the rooms 44, 46, 48 to be climate controlled. By means of the flaps 54 and 72, furthermore, the amount of air from the respective supply air channel 20, 22 is controlled independently from each other.

The air-conditioner according to the invention is able to maintain a variable temperature in each supply air channel, wherein a minimum supply air temperature may be adjusted to a minimum target value and/or the maximum supply air temperature may be adjusted to a maximum target value.

The first supply air channel 20 and the second supply air channel 22 may comprise cross-sections of different size for supply air quantities of different amount and for cooling and/or heating registers having differing power. In the following, the first supply air channel 20 is designed for a lower supply air volume. The cross-section of the first supply air channel is smaller. The second supply air channel 22 is designed for a larger supply air volume. The cross-section of the second supply air channel 22 is larger.

EXAMPLE 1

The rooms 44, 46, 48 have to be heated at an outside temperature of 0° C. In case the first supply air channel 20 is sufficient in order to cover up for the heating demand of the rooms 44, 46, 48, the second supply air channel 22 is decoupled from the rooms 44, 46, 48, i.e. the flaps 72, 28 are closed. The flaps 54 of the first supply air channel 20 are open. The heating register 34 in the first supply air channel 20 can also be open, whereas the heating register in the second supply air channel 22 is closed.

EXAMPLE 2

The outside temperature is, for example, −10° C. In this case, it may happen that the heating power in the first supply air channel 20, as described in example 1, is not sufficient anymore in order to heat up the rooms 44, 46, 48. In this case, the first supply air channel 20 which comprises a lower heating power because of the smaller heating register 34 and because of the lower maximum supply air volume stream, can be closed. The second supply air channel 22 which has a higher heating power as compared to the First supply air channel 20, is opened, i.e. the flaps 74 are opened. The flaps 54 and 24 of the first supply air channel 20 are closed. The heating register 34 of the first supply air channel 20 is also closed. The heating register 60 of the second supply air channel 22 is opened.

EXAMPLE 3

There is, for example, an outside temperature of −20° C. All rooms 44, 46, 48 have an increased heating demand. In this case, it may be that the heating power of the second supply air channel 22 with the heating register 60 provided therein, is not sufficient in order to heat up the rooms 44, 46, 48. Now, the first supply air channel 20 is additional opened in which the flaps 54 and 24 are opening up and the heating register 34 is also opening up.

In case of a reduction of the heating power, the channels may be controlled down in analogy to the examples 1 to 3. The switching of the supply air channels 20, 22 according to the examples 1 to 3 is used in analogy in case of cooling. In the rooms 44, 46, 48, there is a cooling demand everywhere. The same is true for the case of cooling.

The invention is characterized with respect to the previously known state of the art in that the temperature in the two supply air channels 20, 22 can vary extremely each, for example from 12° C. to 45° C. Furthermore, also the respective supply air quantity can vary from a minimum, i.e. the minimum fresh air supply in the respective rooms, to a maximum, i.e. the maximum heating or cooling or moistening or de-moistening.

According to an embodiment of the invention, the first supply air channel 20 may comprise a smaller cross-sectional area than the second supply air channel 22. Thereby, differing amounts of air may be supplied in both supply air channels 20, 22 to the rooms 44, 46, 48. This is important in particular for differing heating and/or cooling demand.

In case the cooling demand or the heating demand is very high in the rooms 44, 46, 48 as has been described above with reference to the examples 1 to 3, the supply air channel 22 having the larger cross-sectional area, is activated. In case the cooling or heating demand is lower, the supply air channel 20 having the smaller cross-sectional area, is activated.

However, it is now also possible that a mixed operation takes place, i.e. that one or the other of the rooms 44, 46, 48 is cooled or one or the other of the rooms 44, 46, 48 is heated respectively. Depending on the larger cooling demand or heating demand for the room 44, 46, 48, the larger supply air channel, i.e. the second supply air channel 22 is activated for the cooling or heating demand, and, correspondingly, the first supply air channel 20 is activated at a lower supply air volume for the cooling or heating demand.

For example in winter time, the second supply air channel 22 is a hot air channel, i.e. the rooms 44, 46, 48 are heated by this channel. The first supply air channel 20 having the smaller supply air volume, is activated for cooling, i.e. the rooms 44, 46, 48 are cooled through this supply air channel 20 on demand.

In summer time, the second supply air channel 22 having the larger supply air volume, is, for example, than the cooling channel, and the first supply air channel 20 having the smaller supply air volume, is the heating channel. Correspondingly, the rooms 44, 46, 48 are cooled or heated through one or the other channel.

Among others, the temperature value of the temperature sensor 38 in the first supply air channel 20 as well as the temperature value of the temperature sensor 64 in the second supply air channel 22 are used for opening and closing the respectively assigned flaps 54, 72 in the first or the second supply air channel 20 or 22. In case cooling or heating takes place in both supply air channels 20, 22, the flaps 54, 72 associated each to the supply air channels 20, 22, are opened or closed pro-rata. In case both channels have the same supply air temperature, the flap positions of the flaps 54, 72 are the same for the respective room 44, 46, 48. This means that, at high heating/cooling demand, both flaps are opened to 100%, in case the heating/cooling demand is essentially covered, the flaps are, for example opened only to 30%. The opening values of the flaps may vary from one room to the other.

In analogy to the heating and cooling case of the rooms 44, 46, 48, the supply air channels can also be activated and de-activated for moistening and de-moistening.

According to the invention, it is now possible that the valve units 54, 72 may be adjusted independently from each other. Thereby, far reaching possibilities are resulting. For example, it is now possible that the maximal possible supply air from the one channel as well as from the other channel is let into the room to be climate controlled in order to allow a fast heating or cooling, for example. Thereby, the flexibility of the system but also the reaction speed may be increased. Preferably, one of the factors pressure, temperature, moisture, density in the supply air channel may be adjusted independently from the respective factor in the other supply air channel.

It is also a further aspect that, by decoupling the valve units, an on demand supply of at least one supply air channel 20, 22 with a further one-channel system provided upstream, is possible. By means of the independently adjustable valve units 54, 72, pressure variations incurred, can be balanced.

LIST OF REFERENCE SIGNS

10 two-channel air-conditioner
12 central supply air channel
14 supply air motor
16 heating register
18 temperature sensor
20 first supply air channel
22 second supply air channel
24 flap in the first supply air channel
26 motor in the first supply air channel
28 flap in the second supply air channel
30 motor in the second supply air channel
32 cooling register
34 heating register
36 moistening device
38 temperature sensor
40 moisture sensor
42 pressure sensor
44 room to be climate controlled
46 room to be climate controlled
48 room to be climate controlled
50 branch channel of the first supply air channel
52 air inlet in the room to be climate controlled, air inlet device
54 flap in the first branch channel
56 motor for the flap in the first branch channel
58 cooling register
60 heating register
62 moistening device
64 temperature sensor
66 moisture sensor
68 pressure sensor
70 second branch channel
72 flap in the second branch channel
74 motor for the flap in the second branch channel
76 temperature sensor
78 moisture sensor
80 air quality sensor

The invention claimed is:

1. A two-channel air-conditioner for the climate control of a number of rooms and room zones, comprising:

each of said rooms includes a common air inlet device in communication with said room;

a first air supply channel and a second air supply channel; said first air supply channel includes a first temperature sensor and a first air pressure sensor therein, said first temperature sensor measures air temperature in said first air supply channel at a first air temperature and said first air pressure sensor measures air pressure in said first air supply channel; and, said second air supply channel includes a second temperature sensor and a second air pressure sensor therein, said second temperature sensor measures air temperature in said second air supply channel at a second air temperature and said second air pressure sensor measures air pressure in said second air supply channel;

said first air supply channel includes a first cross-sectional area and said second air supply channel includes a second cross-sectional area;

said second cross-sectional area of said second air supply channel is larger than said first cross-sectional area of said first supply channel;

a cooling and a heating register in said first air supply channel; and, a cooling and a heating register in said second air supply channel;

each room includes a temperature regulator set for a temperature, Troom target;

a first valve unit and a second valve unit;

said first valve unit interposed between said common air inlet device and said first air supply channel;

said second valve unit interposed between said common air inlet device and said second air supply channel;

said first air supply channel and said second air supply channel providing air into and through said common air inlet device and into said room;

means for independently controlling said first valve unit and said second valve unit such that air quantities from said respective first and second air supply channels to said room to be climate controlled are adjusted independently from each other based on said first air temperature of said first air supply channel measured by said first temperature sensor in said first air supply channel and based on said second air temperature of said second air supply channel measured by said second temperature sensor in said second air supply channel.

2. A two-channel air-conditioner for the climate control of a number of rooms and room zones according to claim 1 wherein said first and second valve units are arranged and controlled such that only one of said first or second air supply channels is connected to said common air inlet device of a room to be climate controlled.

3. A two-channel air-conditioner for the climate control of a number of rooms and room zones according to claim 1:

a first air density sensor for measuring first air density in said first air supply channel;

a second air density sensor for measuring second air density in said second air supply channel;

and wherein said first air pressure measured by said first pressure sensor in said first air supply channel and said first air density measured by said first air density sensor in said first air supply channel in said first air supply channel are adjusted independently from said second air pressure measured by said second pressure sensor in said second air supply channel and said second air density measured by said second air density sensor in said second air supply channel.

4. A two-channel air-conditioner for the climate control of a number of rooms and room zones according to claim 1 further comprising:

said means for independently controlling said first valve unit and said second valve units includes a control circuit;

said control circuit communicating with temperature sensors in said rooms, said temperature sensors in said supply air channels, said first temperature sensor in said first air supply channel and said second temperature sensor in said second air supply channel, and said temperature regulators in said rooms to be climate controlled; and, said control circuit outputs a control signal for opening said cooling or heating registers only when said temperature in said first or second air supply channels for cooling or heating said rooms to be climate controlled is not sufficient considering said amount of air required to heat or cool said rooms.

5. A two-channel air-conditioner for the climate control of a number of rooms and room zones according to claim 3 wherein said first air pressure and said second air pressure in said air supply channels is controlled depending on said required air quantities by said first and second valve units and by air supply motors, and wherein said first valve unit is a flap and said second valve unit is a flap.

6. A two-channel air-conditioner for the climate control of a number of rooms and room zones according to claim 1 wherein a further air supply channel also selectively comprises a heating and cooling register.

7. A two-channel air-conditioner for the climate control of a number of rooms and room zones according to claim 1 wherein said cooling and heating registers of said first and second air supply channels are adjustable in a pre-determined temperature range.

8. A two-channel air-conditioner for the climate control of a number of rooms and room zones according to claim 1 wherein the minimum supply air temperature in said first and second air supply channels corresponds essentially to the minimum temperature of the system.

9. A two-channel air-conditioner for the climate control of a number of rooms and room zones according to claim 1 wherein the amount of air supplied to said first and second air supply channels is independently controlled based on said target room temperature, Troom target.

10. A two-channel air-conditioner for the climate control of a number of rooms and room zones according to claim 1 wherein the quantity of air supplied varies from room to room or from zone to zone depending on the difference between the temperature (Troom actual) in the room to be climate controlled or the room zone to be climate controlled and the pre-determined temperature target value (Troom target).

11. A two-channel air-conditioner for the climate control of a number of rooms and room zones according to claim 1 further comprising moistening and de-moistening devices residing in said first air supply channel and said second air supply channel, said moistening and de-moistening devices are selectively activated.

12. A two-channel air-conditioner for the climate control of a number of rooms and room zones according to claim 11 comprising additional cooling and heating devices in said first air supply channel and said second air supply channel, said additional cooling and heating devices are selectively activated.

13. A two-channel air-conditioner for the climate control of a number of rooms and room zones according to claim 1, further comprising said cooling and heating registers and moistening and de-moistening devices are designed according to said maximum supply air quantity necessary in the respective air supply channel.

14. A two-channel air-conditioner for the climate control of a number of rooms and room zones according to claim 3, further comprising:

a first moisture sensor for measuring moisture in said first air supply channel and a second moisture sensor for measuring moisture in said first air supply channel: and, wherein said control of said air quantities, pressures, temperatures and moisture values in said air supply channels are affected depending on said density values in said air supply channels and said rooms and room zones to be ventilated.

15. A two-channel air-conditioner for the climate control of a number of rooms and room zones, comprising:

each of said rooms includes a common air inlet device in communication with said room;

a first air supply channel and a second air supply channel; said first air supply channel includes a first temperature sensor and a first air pressure sensor therein, said first temperature sensor measures air temperature in said first air supply channel at a first air temperature and said first air pressure sensor measures air pressure in said first air supply channel; and, said second air supply channel includes a second temperature sensor and a second air pressure sensor therein, said second temperature sensor measures air temperature in said second air supply channel at a second air temperature and said second air pressure sensor measures air pressure in said second air supply channel;

said first air supply channel includes a first cross-sectional area and said second air supply channel includes a second cross-sectional area;

said second cross-sectional area of said second air supply channel is larger than said first cross-sectional area of said first supply channel;

a cooling and a heating register in said first air supply channel and a cooling and a heating register in said second air supply channel;

each room includes a temperature regulator set for a temperature, Troom target;

a first branch channel connected to said first air supply channel;

a first valve unit in said first branch channel;

a second branch channel connected to said second air supply channel;

a second valve unit in said second branch channel;

said first and second branch channels being connected together forming a common branch channel, said common branch channel connected to said common air inlet device; and, said first air supply channel and said second air supply channel providing air into and through said first and second branch channels and said common branch channel and to and through said common air inlet device and into said room;

means for independently controlling said first valve unit and said second valve unit such that air quantities from said respective first and second air supply channels to said room to be climate controlled are adjusted independently from each other based on said first air temperature of said first air supply channel measured by said first temperature sensor in said first air supply channel and based on said second air temperature of said second air supply channel measured by said second temperature sensor in said second air supply channel.

16. A two-channel air-conditioner for the climate control of a number of rooms and room zones according to claim 15 wherein said amounts of air supplied to said first and second air supply channels are independently controlled based on said target room temperature, Troom target.

17. A two-channel air-conditioner for the climate control of a number of rooms and room zones, comprising:

each of said rooms includes a common air inlet device in communication with said room;

a first air supply channel and a second air supply channel; said first air supply channel includes a first temperature sensor and a first air pressure sensor therein, said first temperature sensor measures air temperature in said first air supply channel at a first air temperature and said first air pressure sensor measures air pressure in said first air supply channel; and, said second air supply channel includes a second temperature sensor and a second air pressure sensor therein, said second temperature sensor measures air temperature in said second air supply channel at a second air temperature and said second air pressure sensor measures air pressure in said second air supply channel;

said first air supply channel includes a first cross-sectional area and said second air supply channel includes a second cross-sectional area;

said second cross-sectional area of said second air supply channel is larger than said first cross-sectional area of said first supply channel;

a cooling and a heating register in said first air supply channel; and, a cooling and a heating register in said second air supply channel;

each room includes a temperature regulator set for a temperature, Troom target;

a first valve unit and a second valve unit;

said first valve unit interposed between said common air inlet device and said first air supply channel;

said second valve unit interposed between said common air inlet device and said second air supply channel;

said first air supply channel and said second air supply channel providing air into and through said common air inlet device and into said room;

a control circuit communicating with temperature sensors in said rooms to be climate controlled, said first temperature sensor in said first supply air channel, and said second temperature sensor in said second supply air channel;

said control circuit outputs a control signal for opening said cooling or heating registers only when said temperature in said first or second air supply channels for cooling or heating said rooms to be climate controlled is not sufficient considering an amount of air required to heat or cool said rooms; and, said control circuit outputs a control signal for opening said first valve unit and said second valve unit such that air quantities from said respective first and second air supply channels to said room to be climate controlled are adjusted independently from each other based on said temperature measured by said first temperature sensor of said first air supply channel and based on said temperature measured by said second air temperature sensor of said second air supply channel.

* * * * *